US005209274A

United States Patent [19]

LaWarre, Sr.

[11] Patent Number: 5,209,274

[45] Date of Patent: May 11, 1993

[54] FILLING VALVE APPARATUS HAVING SHORTENED VENT TUBE

[75] Inventor: Robert W. LaWarre, Sr., Titusville, Fla.

[73] Assignee: LaWarre Precision Technologies Incorporated, Titusville, Fla.

[21] Appl. No.: 744,317

[22] Filed: Aug. 13, 1991

[51] Int. Cl.[5] ..... B65B 31/00

[52] U.S. Cl. ..... 141/39; 141/302; 141/57

[58] Field of Search ..... 141/6, 39, 40, 54, 57, 141/59, 146, 147, 301, 302, 305

[56] References Cited

U.S. PATENT DOCUMENTS

| | | | |
|---|---|---|---|
| 2,467,684 | 4/1949 | Meyer et al. | 141/54 X |
| 3,032,077 | 5/1962 | Plock et al. | 141/39 |
| 3,699,740 | 10/1972 | Knabe | 141/39 X |
| 4,206,789 | 6/1980 | Jordan et al. | 141/39 |
| 4,363,339 | 12/1982 | Puskarz | 141/39 |

FOREIGN PATENT DOCUMENTS

| | | | |
|---|---|---|---|
| 1129850 | 5/1962 | Fed. Rep. of Germany | 141/302 |
| 1216722 | 5/1966 | Fed. Rep. of Germany | 141/39 |

*Primary Examiner*—Henry J. Recla
*Assistant Examiner*—Casey Jacyna
*Attorney, Agent, or Firm*—Reising, Ethington, Barnard, Perry & Milton

[57] ABSTRACT

A filling valve apparatus (10) includes a housing (12) having a passage (20) for receiving an actuated shaft (56) extending partially therethrough connected to a charging cap (84) and in turn to the valve stem (118) and vent tube (64). An isolator member (32) is connected about the shaft (56) and to the valve stem (118) for allowing gas to flow freely therein. The apparatus (10) provides for a shortened valve stem (118) and vent tube (64) to a height less than the apparatus (10) height to decrease the amount of gas requiring snifting while allowing unrestricted gas to flow therethrough when open.

6 Claims, 4 Drawing Sheets

FILLING VALVE APPARATUS HAVING SHORTENED VENT TUBE

TECHNICAL FIELD

The invention relates to machinery for filling containers, such as bottles and cans, with carbonated and non-carbonated liquids, and more particularly to an improved filling valve for filling such containers.

BACKGROUND ART

Automatic machinery is used in modern bottling facilities for filling containers with gaseous liquid containing carbon dioxide and similar carbonation under counter pressure, and for filling containers with nongaseous liquids. The machinery enables predetermined quantities of liquid to be delivered into the containers. The machinery includes mechanisms for handling the containers in which the empty containers are raised until the neck engages the filling device in order to receive a predetermined volume of liquid at which time the containers are lowered and directed toward the machine. The filling machinery includes a reservoir containing a liquid which flows under the effective gravity. The gas above the liquid maintains the carbon dioxide in the liquid and is used to charge the container. A filling valve is located in the reservoir and extends through the tank. The filling valve connects the reservoir with the empty container and opens to allow the container to be filled with liquid. When the container is engaged with the filling device, the gas valve fills the container with counter pressure gas. The bottle is then filled with liquid by opening the filling valve. During filling, the gas contained in the container is evacuated through a vent tube toward a gas chamber in the tank. As soon as the level of liquid in the container reaches the aperture of the tube, the gas, which is located in the neck of the container, can no longer escape and the flow is stopped. The liquid and gas valves are then closed. A snifter is operated to release the remaining pressure in the container and in the valve stem.

U.S. Pat. No. 4,979,546, issued Dec. 25, 1990 in the name of LaWarre, Sr. et al, and assigned to the assignee of the subject invention, discloses a filling valve assembly operative to fill containers to predetermined heights. The apparatus utilizes a vent tube extending through the housing from the charging cap which is directly actuated upon by the actuator or lever. The problem with this type of assembly is that the entire gas contained within the vent tube must be snifted. The proportion of gas to liquid in smaller containers increases which causes a great amount of foaming during the snifting process. Therefore, it is desirable to decrease the amount of gas in the vent tube snifted.

U.S. Pat. Nos. 4,140,158 to Heckmann et al and U.S. Pat. No. 3,757,835, issued to Copping and U.S. Pat. No. 3,699,740, issued to Knabe discloses filling valve systems which have a shortened vent tube. However, vent tube is shortened by utilizing a restriction within the original vent tube in order to adjust the valve tube length in the post valve. This design designs back pressure in the post valve area, slows the counter pressure, and slows escapement of $CO_2$.

SUMMARY OF THE INVENTION AND ADVANTAGES

The invention includes a filling valve apparatus for filling containers with the liquid. The apparatus includes longitudinally extending housing means having a passage for allowing liquid to flow therethrough and includes an inlet for allowing liquid to flow into the housing means and the passage. An outlet allows liquid to flow out of the housing means and the passage and to the container. The housing means also includes a valve seat between the inlet and the outlet. Valve means are included which are movable within the passage within the inlet and the outlet and includes sealing means moving against the valve seat for preventing liquid from flowing through the passage to the outlet and moving away from the valve seat for liquid to flow through the passage to the outlet. The valve means includes a valve stem movable within the passage and extending within the housing means to the outlet wherein the valve stem includes a passageway for allowing gas to pass therethrough. Isolator means operatively connects to and extends from the valve stem through the housing means. The isolator means has a hollow center for allowing gas to pass therethrough to the valve stem while isolating liquid between the isolator means and the housing means. The valve means includes actuator means extending through the hollow center of the isolator means to the valve stem for controlling operation of the valve stem.

BRIEF DESCRIPTION OF THE DRAWINGS

Advantages of the present invention will be readily appreciated as the same becomes better understood by reference to the following detailed description when considered in connection with the accompanying drawings wherein.

DESCRIPTION OF THE PREFERRED EMBODIMENT

Figure 1:
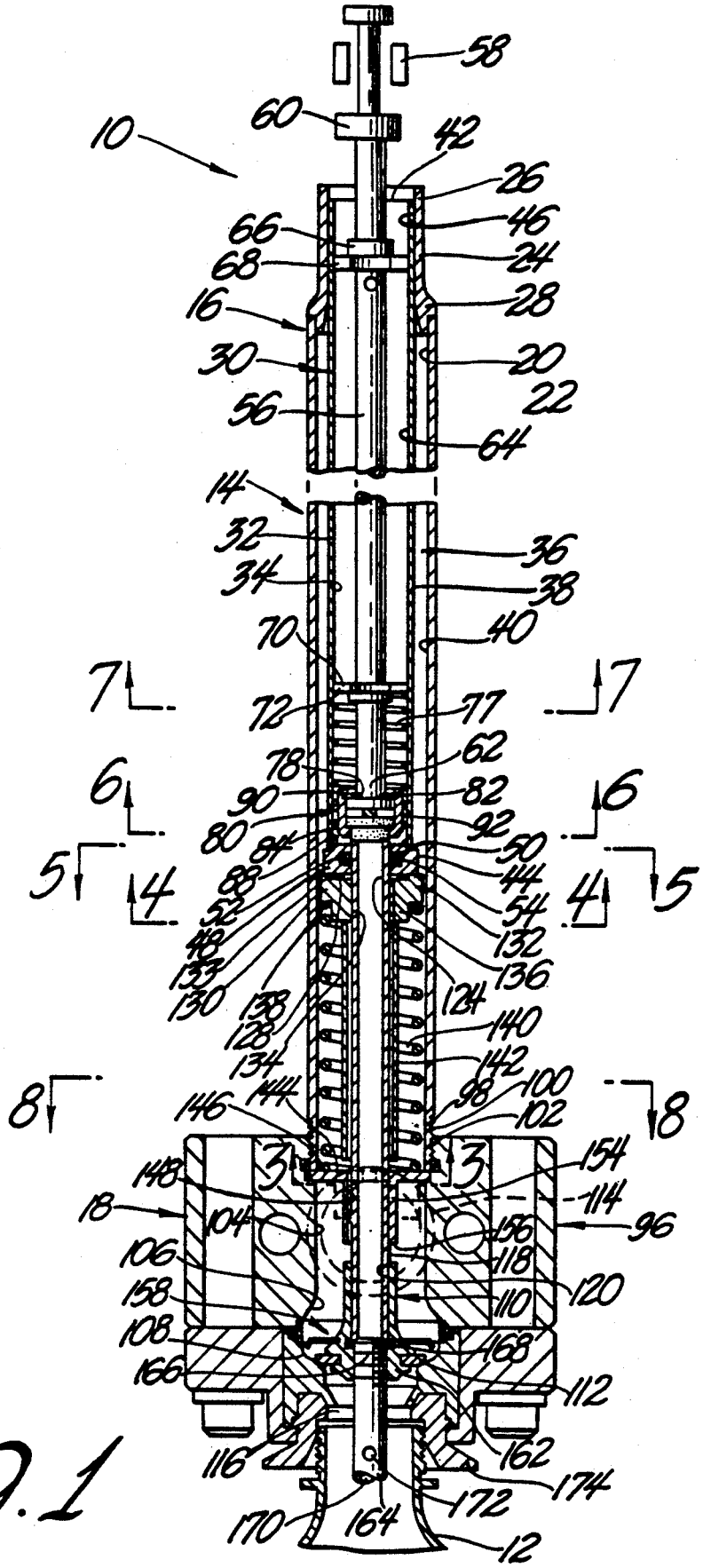
FIG. 1 cross sectional view of a portion of the subject invention in the closed position.
Figure 2:
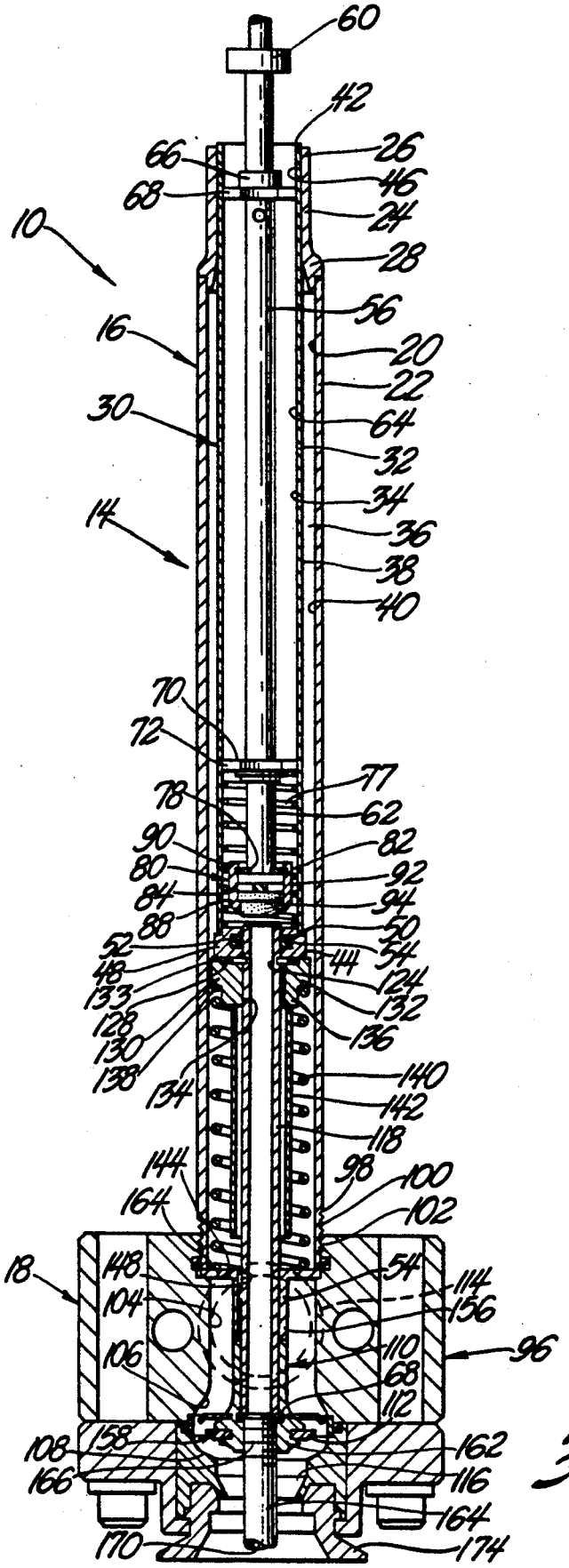
FIG. 2 is a cross sectional view of the subject invention in the open and filling positions.
Figure 3:
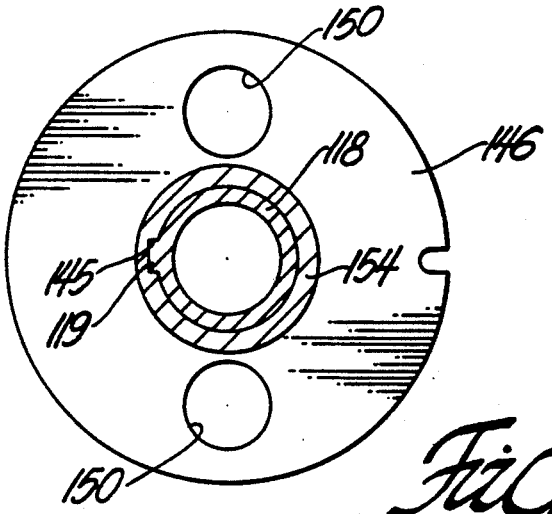
FIG. 3 is a cross sectional view taken along lines 3—3 of FIG. 1.
Figure 4:
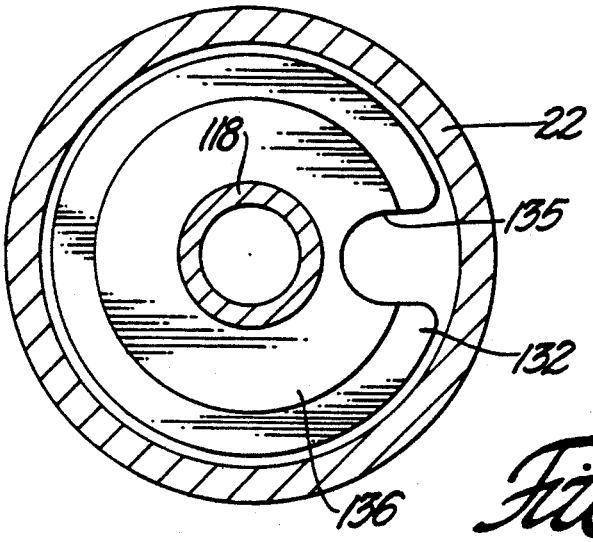
FIG. 4 is a cross sectional view taken along lines 4—4 of FIG. 1.
Figure 5:
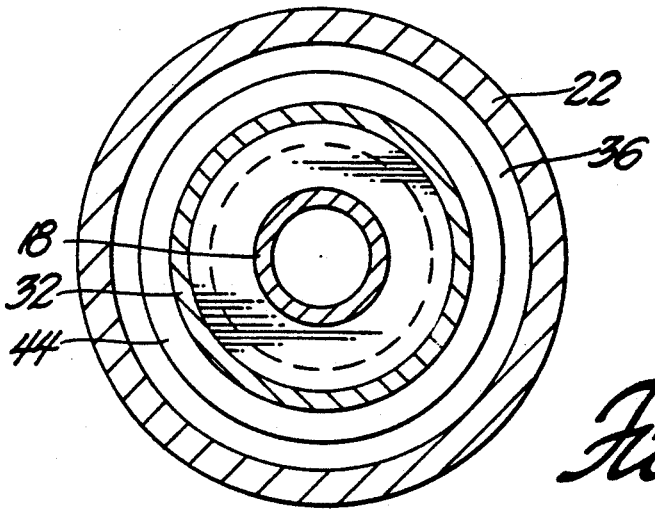
FIG. 5 is a cross sectional view taken along lines 5—5 of FIG. 1.
Figure 6:
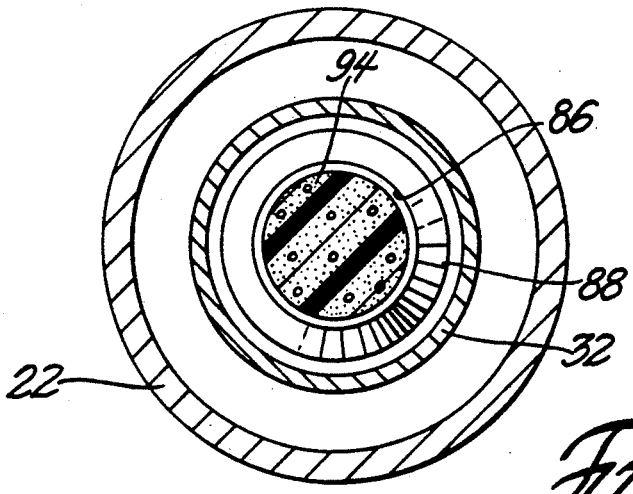
FIG. 6 is a cross sectional view taken along lines 6—6 of FIG. 1.
Figure 7:
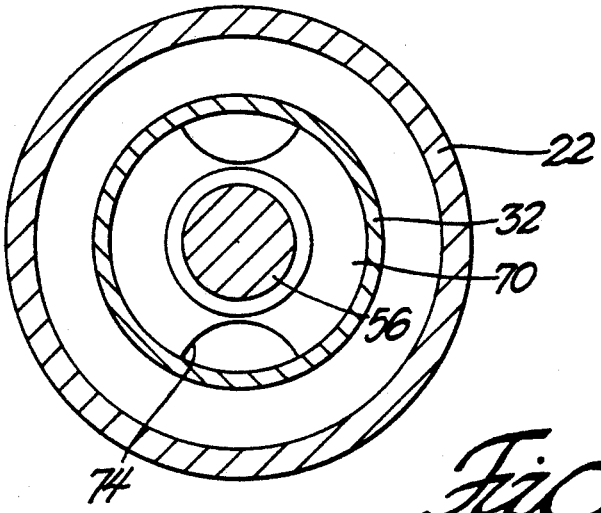
FIG. 7 is a cross sectional view taken along lines 7—7 of FIG. 1.

A filling valve apparatus for filling containers 12 with a liquid is generally shown at 10 in FIGS. 1 and 2. Generally, filling machines utilizing such an assembly 10 may be provided with a movable filling table having a plurality of vertically movable container 12 supports which are spaced about the circumference of the table and adapted to receive containers 12, such as bottles, cans or the like. The supports raise the containers 12 into sealing engagement with the filling assembly 10 where the containers 12 are filled with carbonated liquid, and thereafter lowered and removed from the platforms.

The filling machines are provided with the filling reservoir. The reservoir is supplied with a carbonated liquid which may be a premixed liquid comprising syrup, fruit pulp or the like. The carbonated liquid is supplied to the reservoir through connections as are commonly known in the art. One filling valve apparatus 10 is in vertical alignment with each container 12. A body of gas or air at a suitable pressure is supplied to the upper portion of the filling valve assembly 10 and the reservoir. The pressure of gas or air is maintained at a desired pressure as commonly known in the art.

The filling valve 10 includes housing means 14 comprising an upper portion 16 and a lower valve portion 18. The upper portion 16 includes a passage 20 therethrough. The upper housing portion 16 includes a main housing cylinder 22 and a flared housing portion 24 comprising a top cylindrical section 26 having a diameter less than the diameter of the main housing cylinder 22 and a tapering cylindrical member 28 extending from the smaller diameter top cylindrical section 26 to the larger diameter main housing cylinder 22. The main housing cylinder 22 and flared housing portion 24 are fixedly connected by press fitting or soldering, etc. Isolator means 30 is operatively connected within the housing means 14 and includes a tubular cylindrical isolator member 32 having an opening 34 extending longitudinally therethrough. A separation or space 36 is provided between the exterior surface 38 of the isolator member 32 and the interior surface 40 of the main housing cylinder 22 to receive liquid, as subsequently discussed.

The isolator member 32 includes an upper open end 42 and a lower end 44. The upper open end 42 slideably contacts the interior surface 46 of the top cylindrical section 26 of the flared housing portion 24. The lower end 44 is integrally connected to an isolator base 48 comprising a solid cylindrical base with an aperture 50 therethrough. The aperture 50 includes radially extending grooves 52 in the center thereof for receiving a liquid seal 54. The seal 54 fills within the grooves 52 and extends slightly into the aperture 50.

Inserted within the opening 34 of the isolator member 32 is a actuated member or shaft 56 extending from actuating means 58 at a first end 60 to a second end 62. $CO_2$ or gas is received between the interior surface 64 of the isolator member 32 and the actuated shaft 56. The actuated shaft 56 has a diameter much less than the diameter of the isolator member 32 to provide a resonance chamber for the gas without any restriction to the free flow of gas to the container 12. An upper guide member 66 is fixedly attached to and near the first end 60 of the shaft 56 by soldering or the like. The upper guide member 66 includes a radially extending flange 68 slideably in contact the interior surface 64 of the isolator member 32 to guide the actuated shaft 56 during movement thereof to retain same centered within the isolator member 36. The second end 62 of the actuated shaft 56 includes a similar lower guide member 70 connected to the shaft 56 with a flange 72 slideably contacting the isolator member 32 to retain the shaft centered within the isolator member 32. Each of the guide members 66, 70 includes two semi-circular notches 74 in the flanges 68, 72 for allowing the gas within the isolator member 32 to flow therepast. An upper coil spring 77 is operatively connected between the base 48 and the lower guide member 70 for biasing and maintaining the base 48 against the guide 32.

The second end of the actuated shaft 62 includes a groove 78 therein which is secured to charging means 80. The charging means 80 includes a retainer ring 82 and the groove 78 receives the retainer ring 82 for securing the shaft 62 to the charging means 80. The charging means 80 includes a is generally cup-shaped charging cap 84 having an aperture 86 at its base 88 and including radial grooves 90 within its upper extending wall 92. The radial grooves 90 receive the retaining ring 82 to secure the actuated shaft 62 to the charging means 80. Within the charging cap 84 is located a generally inverted hat-shaped rubber seal 94 within the aperture 86 and against the base 88 thereof.

The lower valve portion 18 of the housing means 14 includes a valve block 96 fixedly connected to the lower end 98 of the main housing cylinder 22. The main housing cylinder 22 includes a threaded exterior surface 100 for mating with a threaded bore 102 of the valve block 96. The valve block 96 forms a cylindrical bore 104 having an enlarged valve area 106 tapering to the outlet 116. The lower portion of the enlarged valve 106 area provides a valve seat 108.

Valve means 110 is included which is slideable and movable within the passage 20. The valve means 110 includes sealing means 112 for moving against the valve seat 108 to prevent liquid from flowing through the passage 20 from an inlet 114 to the outlet 116 and to move away from the valve seat 108 for allowing liquid to flow through the passage 20 to the outlet 106. The valve means 110 includes a valve stem 118 movable within the passage 20 and extending from the charging cap 84 within the housing means 14 and to the outlet 106. The valve stem 118 includes a gas passageway 120 therethrough for allowing gas to pass therethrough. The valve stem 118 is connected within the isolator base 48 through the aperture 50 against the liquid seal 54. The diameter of the valve stem 118 is less than the diameter of the isolator cylindrical section 26. A first end 122 of the valve stem 118 includes a radial notch 124 on its exterior surface 126 for receiving a liquid valve retainer ring 128.

A liquid valve guide 130 is provided having a flange portion 132 radially extending to the interior surface 40 of the main housing cylinder 22. The guide 130 includes an aperture 134 therein for slideably receiving the valve stem 118. A groove 133 is included for receiving the liquid valve retainer ring 128 to retain the valve stem 118 to the valve guide. The liquid valve guide 130 includes a smaller diameter apertured cylinder 136 providing a lower shoulder 138 for receiving the upper end of a lower spring 140 thereagainst. The flange portion 132 include a notch 135 therein for allowing liquid to flow therethrough.

A valve stop hollow cylinder 142 is provided between the lower shoulder 138 of the liquid valve guide 130 and a spring seat 144 formed at the lower end of the main housing cylinder 16. The stop cylinder provides 142 a minimum lower distance that the valve guide 130 can move. The spring seat 144 is formed by a seat cylinder 146 secured against the lower end of the main housing cylinder 22 with an aperture 148 therein for slideably receiving the valve stem 118. The spring seat 144 includes two apertures 150 extending therethrough to allow liquid to flow therethrough. The spring seat 144 includes a notch 145 therein to make with a tab 119 on the valve stem 118 to prevent rotation. The spring seat 144 abuts against the lower end of the main housing cylinder 22 in a generally cylindrical portion 146 and which tapers to a shell 154 extending along the valve stem 118 ending in a lower edge 156. A tulip valve 158 is connected to the second end 160 of the valve stem 118 within the enlarged portion 106 and is of a generally standard tulip liquid valve configuration. The top of the valve 158 is spaced from the valve seat 108 in the closed position, and abuts same in the open position. The valve stem 118 allows a lesser volume of gas to flow therein than the isolator member 32 by the difference in diameters thereby preventing any restriction of the gas flow out of the container 12 through the valve stem 118 and into the isolator 32.

The valve stem 118 includes at the tulip valve 158 a threaded bore 162 for receiving a vent tube 164 having threads 166 to be received within the valve 158 and includes an annular resilient seal 168 therein for sealing the vent tube 164 to the valve stem 118. The vent tube 164 is effectively an extension of the valve stem 118. the vent tube 164 has an open bottom 170 and a pair of side apertures 172. The vent tube 164 also has an annular liquid spreading member (not shown) formed by the inner surface of the expanding surface to spread the liquid in the neck of the container 12. When the liquid filling the container 12 rises to cover the side apertures 172, the gas pressure is cut off which stops the flow of liquid into the container 12 preventing further filling thereof.

A container seal 174 may be a resilient rubber member and fits into an annular grooved area 176 the valve block 96. A cone shaped end guides the container top into place.

Figure 8:
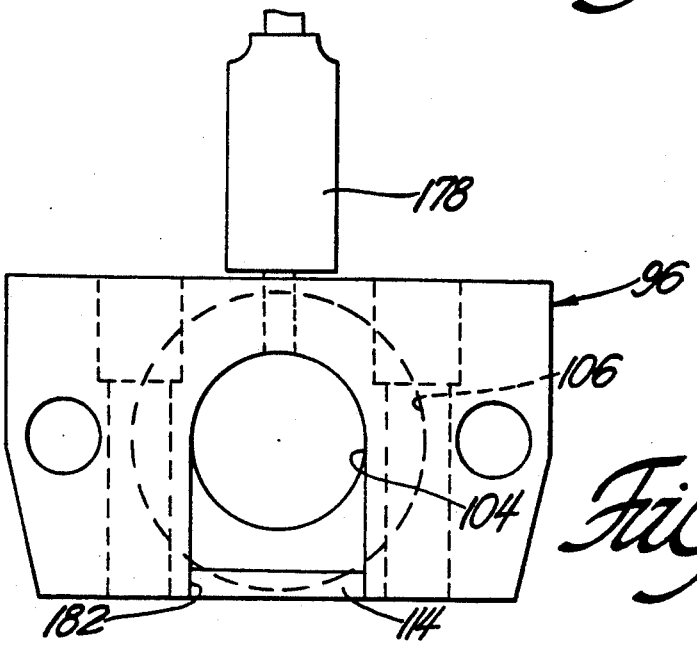
FIG. 8 is a cross sectional view taken along lines 8—8 of FIG. 1.

The valve block 96 provides for the snifter 178, and a side opening 182 (FIG. 8) acting as the inlet 114 of the liquid into the valve apparatus 10. The configuration of the snifter 178 of the valve 10 and the tulip valve 158 is commonly known in the art, and maybe of the type set forth in U.S. Pat. No. 4,979,546, assigned to the assignee herein, and is therefore incorporated by reference as to the structure of the snifter 178, general valve block 96 and tulip valve 158.

The valve apparatus may be operated by the actuating means 58 comprising a cam or a lever, is commonly known in the art.

In operation, FIG. 1 illustrates the valve assembly 10 in the closed position. Upon requiring opening thereof, a container or bottle 12 is inserted within the container seal 174. Thereafter, the lever or cam actuator 58 raises the shaft 56 which in turn raises the charging cap 84 allowing gas to enter the valve stem 118 and allowing the spring 77 to bias the stem 118 to an upper position to open the valve 158. Closing of the valve 158 occurs in the opposite manner. However, upon closing of the valve 10, gas remains within the valve stem 118 which must be evacuated. Such an evacuation occurs upon snifting of the valve apparatus 10 which relieves the gas pressure within the container 13 and valve stem 118. It is desirable to minimize the amount of gas evacuated by shortening the vent tube 164 as in the subject invention. The length substantially effects the gassing of the full container upon snifting. The reduction of volume of compressed $CO_2$ remaining in the vent tube after filling which must be snifted is directly responsible for foam or no foam. Therefore, the minimum amount of $CO_2$ available for the snifting is very important. The $CO_2$ can not be reduced by a diametrical decrease in dimensions because the same tube must allow unrestricted flow of $CO_2$ when filling the container.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A filling valve apparatus for filling containers with a liquid, said apparatus comprising:

longitudinally extending housing means (14) having a passage (20) for allowing liquid to flow therethrough and including an inlet (114) for allowing liquid to flow into said housing means (14) and said passage (20), an outlet (116) to allow liquid to flow out of said housing means (14) and said passage (20), and having a valve seat (108) between said inlet (114) and said outlet (116);

valve means (110) movable within said passage (20) between said inlet (114) and said outlet (116) and including sealing means (112) moving against said valve seat (108) for preventing liquid from flowing through said passage (20) to said outlet (116) and moving away from said valve seat (108) for allowing liquid to flow through said passage (20) to said outlet (116);

said valve means (110) including a valve stem (118) movable within said passage (20) and extending within said housing means (14) to said outlet (116), said valve stem (118) including a gas passage (120) for allowing gas to pass therethrough;

said valve means (110) further including isolator means (301) operatively connected to and extending from said valve stem (118) and extending through said housing means (14) and having a hollow center for allowing gas to pass therethrough to said valve stem (118) while isolating liquid between said isolator means (301) and said housing means (14), said isolator means including an isolator base (48) having an aperture therein for receiving and securing said valve stem (118);

said valve means (110) including actuated means (58) extending through said hollow center of said isolator means (301) to said valve stem (118) for moving between an open position to allow filling of the container and a closed position preventing liquid from entering the container;

charging means (80) operatively connected between said actuated means (58) and said valve stem (118) within said isolator means (30) for controlling gas passing through said isolator means (30) and into said valve stem (118) in response to said actuated means (58);

said actuated means including a shaft (56) having an end operatively connected to said charging means (80), and guide means (66, 70) extending radially from said shaft (56) for slideably retaining said shaft (56) centrally within said isolator means (30);

biasing means (77) operatively connected between said isolator means (30) and said guide means (66, 70) for biasing said guide means (66, 70) away from said isolator base (48);

a liquid guide member (130) operatively connected to said valve stem (118) adjacent said isolator base (48) and extending radially to said housing means (14) for slideably retaining said valve stem (118) centrally therein;

a lower guide secured to said housing means (14) and having a passage for receiving said valve stem (118) to maintain said valve stem (118) centrally within said housing means (14);

lower biasing means (140) operatively connected between said lower guide (144) and said liquid guide member for biasing said sealing means (112) away from said valve seat (108).

2. An apparatus as set forth in claim 1 wherein said housing means (14) including a generally cylindrical housing (22) having an interior surface, and said isolator means (30) including a tubular isolator member (32) concentric within said cylindrical housing (22) and having interior and exterior surfaces to isolate liquid between said interior surface of said cylindrical housing (22) and said exterior surface of said isolator member (32) and preventing liquid from entering said interior surface of said isolator member (32).

3. An apparatus as set forth in claim 2 wherein, said charging means including a charging cap (84) abutting against said base (48) and valve stem (118) and connected to said actuated means (56) for sealing said valve stem passage (120) closed with said actuated means (56) in said closed position and allowing gas to flow about said charging cap (84) within said isolator means (30) to said valve stem passage (120) in said open position.

4. An apparatus as set forth in claim 3 wherein said isolator means (30) includes a seal (54) between said isolator base (48) and said valve stem (118) for preventing liquid from flowing into said gas passage (20).

5. An apparatus as set forth in claim 4 wherein said lower guide includes apertures therein for allowing liquid to flow therethrough from said inlet.

6. A filling valve apparatus for filling containers with a liquid, said apparatus comprising:

longitudinally extending housing means (14) having a passage (20) for allowing liquid to flow therethrough and including an inlet (114) for allowing liquid to flow into said housing means (14) and said passage (20), an outlet (116) to allow liquid to flow out of said housing means (14) and said passage (20), and having a valve seat (108) between said inlet (114) and said outlet (116);

valve means (110) movable within said passage (20) between said inlet (114) and said outlet (116) and including sealing means (112) moving against said valve seat (108) for preventing liquid from flowing through said passage (20) to said outlet (116) and moving away from said valve seat (108) for allowing liquid to flow through said passage (20) to said outlet (116);

said valve means (110) including a valve stem (118) movable within said passage (20) and extending within said housing means (14) to said outlet (116), said valve stem (118) including a gas passage (120) for allowing gas to pass therethrough said gas passage (120) having a stem diameter;

said valve means (110) including a charging cap operatively acting against said valve stem (118) for allowing and preventing gas to pass from said valve stem (118);

isolator means (30) operatively connected to and extending from said valve stem (118) and extending through said housing means (14) and providing a hollow center for containing said charging cap and allowing gas to pass therethrough to said valve stem (118) and having an isolator diameter within said hollow center greater than said stem diameter for providing unrestricted flow of gas between said valve stem and said isolator means about said charging cap, said isolator means including an isolator base (48) having an aperture therein for receiving and securing said valve stem (118);

said valve means (110) including actuated means (58) extending through said hollow center of said isolator means (30) to said charging cap and said valve stem (118) for moving between an open position to allow filling of the container and a closed position preventing liquid from entering the container;

guide means operatively connected to said actuated means for slideably retaining said actuated means centrally within said isolator means;

biasing means (77) operatively connected between said isolator means (30) and said guide means (66, 70) for biasing said guide means (66, 70) away from said isolator base (48), and a liquid guide member (130) operatively connected to said valve stem (118) adjacent said isolator base (48) and extending radially to said housing means (14) for slideably retaining said valve stem (18) centrally therein;

a lower guide secured to said housing means (14) and having a passage for receiving said valve stem (118) centrally within said housing means (14);

biasing means operatively connected between said lower guide (144) and said liquid guide member for biasing said sealing means (112) away from said valve seat (108).

* * * * *